US005265738A

United States Patent [19]

Yablans et al.

[11] Patent Number: 5,265,738

[45] Date of Patent: Nov. 30, 1993

[54] SHELF DISPLAY DISPENSER FOR PACKAGED MERCHANDISE

[75] Inventors: Gerald Yablans, Port Washington, N.Y.; David C. Miller, New Canaan, Conn.

[73] Assignee: P.O.P. Displays, Inc., Long Island City, N.Y.

[21] Appl. No.: 882,814

[22] Filed: May 14, 1992

[51] Int. Cl.[5] ..... A47F 5/00

[52] U.S. Cl. ..... 211/59.3; 211/184

[58] Field of Search ..... 211/59.3, 59.2, 184; 108/61; 312/61

[56] References Cited

U.S. PATENT DOCUMENTS

| | | | |
|---|---|---|---|
| 4,364,481 | 12/1982 | Ricci | 211/184 |
| 4,685,574 | 8/1987 | Young et al. | 211/59.2 |
| 4,724,968 | 2/1988 | Wombacher | 211/59.3 |
| 4,905,847 | 3/1990 | Hanson | 211/DIG. 1 X |
| 4,923,070 | 5/1990 | Jackle et al. | 211/59.2 |
| 5,024,336 | 6/1991 | Spamer | 211/59.2 |
| 5,111,942 | 5/1992 | Bernardin | 211/59.3 |

*Primary Examiner*—Robert W. Gibson, Jr.

*Attorney, Agent, or Firm*—Nolte, Nolte and Hunter

[57] ABSTRACT

A shelf display dispenser for packaged merchandise in which there are a plurality of display unit suitable for placement on a flat surface, each comprising an elongated base, a longitudinal slot formed in the base suitable to guide a pusher mechanism, an upstanding divider wall on one side only of the base, coupling elements at the outwardly facing side of the divider wall and coupling elements on the longitudinal edge of the base opposite the wall, the second-mentioned coupling elements being positioned and formed to mate with coupling elements on the outwardly facing side of a divider wall of an adjacent unit, whereby the plurality of units may be matingly interlocked by the first and second-mentioned coupling elements in side-by-side parallel alignment for placement on a surface.

21 Claims, 4 Drawing Sheets

FIG. 5
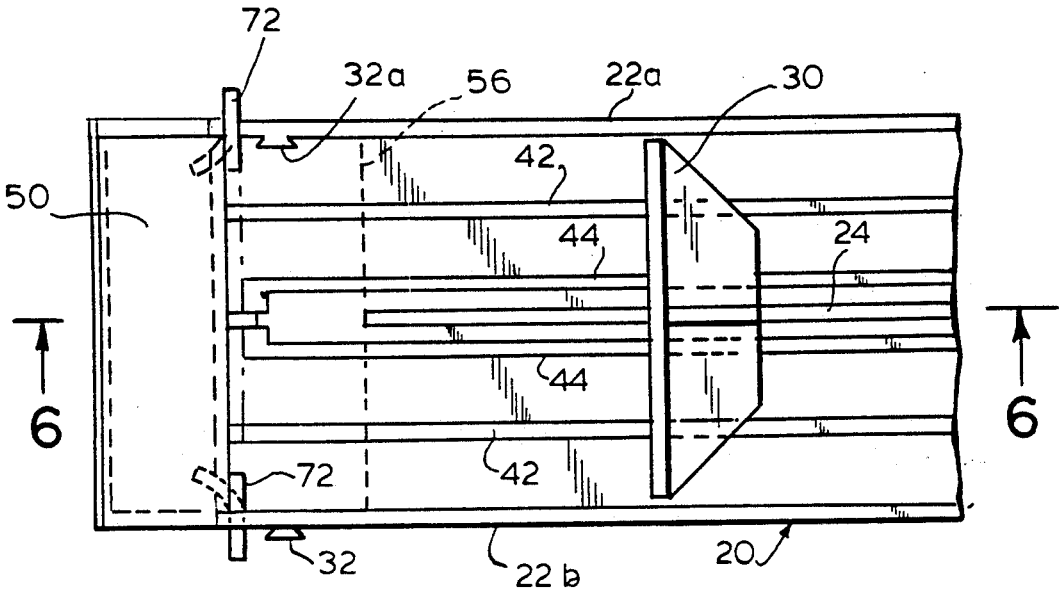
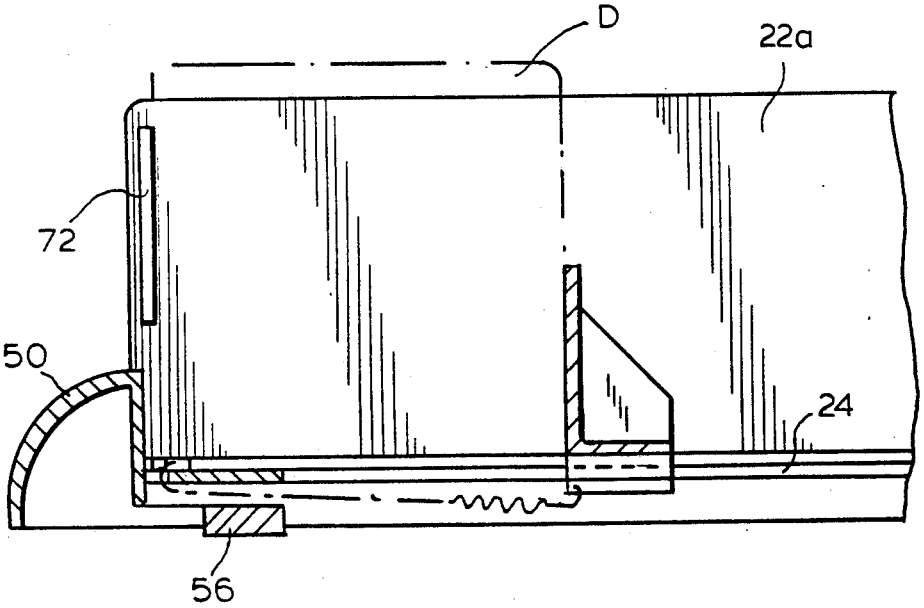
FIG. 6

SHELF DISPLAY DISPENSER FOR PACKAGED MERCHANDISE

FIELD OF THE INVENTION

The present invention relates to shelf display and placement of packages of the type shown in my co-pending application Ser. No. 07/682,856, filed Apr. 5, 1991 and now U.S. Pat. No. 5,190,186. The prior art displays such as disclosed in Stevens U.S. Pat. No. 2,652,154 provide a frame designed to support channels along which a biased pusher can move packages toward the forward edge of a shelf on which the frame is placed. Hawkinson et al U.S. Pat. No. 4,729,481 and Polvere U.S. Pat. No. 4,836,390 provide such guided advancing systems. All of these show rigid frames supporting in one manner or other the channel means along which the goods are guided. They require complicated framework to assist in securing, forming and supporting the channels. Breslow U.S. Pat. No. 4,830,201 shows channels secured to a frame at the delivery end of the channel.

THE INVENTION

By the present invention, the need of supporting framework such as the members 74, 69, 46 of Stevens '154 or transverse channel 22 (22*a*) of Breslow '201 are eliminated. The invention relates to display devices formed by simplified channels with pusher mechanisms. Each channel unit or slider forming the display device has only one side wall but when coupled to adjacent units form parallel channels which may be mounted directly on a shelf or flat surface. These side-by-side units are coupled one to the other for rigidity and require only very simple securing means such as magnets, pressure-sensitive adhesives or pressure-sensitive adhesive tapes to retain the multi unit display on a shelf. In a display the units run from front to rear of the shelf but are placed side by side along the length of the shelf. The last of such units may require a side wall and the same is provided for that unit only. Thus, there are neither double walls between the channels nor additional framing to secure and space separate dividing walls, as for example, in Stevens, supra, or Breslow, supra.

This invention further permits feeding adjacent columns of different sized packages or, stated differently, channels of various widths may be employed in side-by-side coupled relationship. The channels, which may be made of polymer such as styrene or other suitable plastic, wood or metal, may be formed with breakaway end sections, at two inch intervals, for example, to adjust to shelves of varying width (depth).

Thus, it is an object of the invention to provide side by side channel units whose length may be adjusted to the width of a display shelf and whose widths may be selectively taylored to the product. The units are securable to each other by simple but stable means on a shelf or similar surface. This provides excellent rigidity to the assembled display without extraneous support means other than the shelf or flat surface.

A further object of the invention is to provide that such secured units have separating dividers integral with the base track or slide structure. The divider is located on one side only of each track to be shared with the adjacent unit. Such an arrangement substantially halves the number of dividers heretofore used thus providing a reduction in space as well as material.

An alternative object of the invention is to provide flexible side stops secure to the forward end of the dividers to permit withdrawal one by one of product by the customer or retailer. The small flexible stops are almost unnoticeable, do not obscure the legends on the product, and are sufficiently resistent to stop the forward motion of the product on display but sufficiently flexible to permit withdrawal by manual means.

BRIEF DESCRIPTION OF THE DRAWINGS

FIG. 5 is a plan view of the forward end of another embodiment of a unit.

FIG. 6 is a longitudinal sectional elevation on line 6—6 of FIG. 5.

DETAILED DESCRIPTION OF THE DRAWINGS

Figure 4:
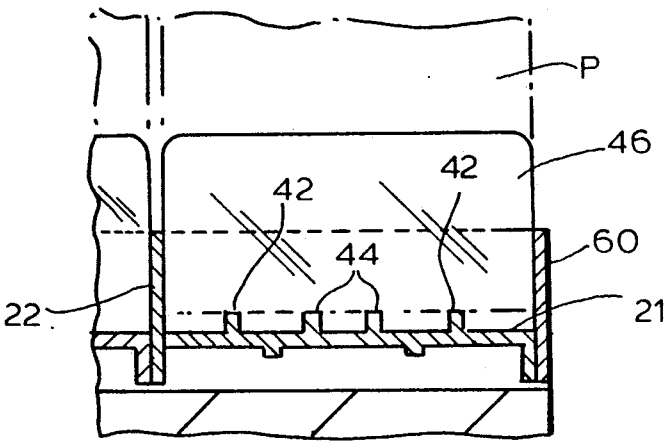
FIG. 4 is a sectional elevation on line 4—4 of FIG. 2.

Referring more specifically to FIGS. 1–4 of the drawings, a display mechanism 18 (FIG. 2) comprises a plurality of sliders 20, 20*a* each having a baseplate 21 (21*a*) and a single integral side wall or divider 22 always on the side of the same hand (left hand as shown in FIG. 4). Base plate 21 (21*a*) of slider 20 (20*a*) has a central longitudinal slot 24 closed at the front end 26 and opened at the rearward end 28. Slot 24 receives and holds the spring loaded pusher foot 30 (30*a*) which may be of the type shown in my co-pending application Ser. No. 07/682,856, now U.S. Pat. No. 5,190,186, incorporated herein by reference and made a part hereof. Pusher foot 30*a* as shown is wider than pusher foot 30. This is not always essential and pusher foot 30 may be used with slider 20*a* in many applications.

The slider 20 has male dovetails 32 and 34 formed on the wall 22 and corresponding female dovetails 36, 38 formed on the opposing edge of baseplate 21 (21*a*) of the slider. Rails 42 may be provided to support packaged goods (shown in phantom in FIGS. 3, 4 and 6) moved along slider 20 (20*a*) by pusher 30. Pusher 30 conveniently slides on rails 44 positioned laterally of slot 24 which holds and guides plow 31 of pusher 30 (30*a*) in a well known manner. An anchor opening 25 is provided to hold the outer end 27 of spring 29 of pusher 30 as more fully explained in my aforementioned co-pending application for patent. While the male and female dovetails could be reversed, I find it better to form the male dovetails 32, 34 on the divider 22 with the female dovetails 36, 38 in the baseplate 21 (21*b*) and not vice versa.

Optionally, a stop plate 46 is provided at the front of the slider, and in the figures is shown to be made of a clear plastic. The stop plate 46 arrests the forward movement of the packages while permitting one to view the package therethrough. Pusher 30 is conveniently arrested by the closed end 26 of slot 24 when the last package is removed. The plastic stop plate 46 is attached to a plate 48 which, in turn, is secured to the front of the base 21 (21*a*). Opaque front piece 50 secured to the front of slider 20 is provided for product labeling, price labeling and the like.

The base 21 (21*a*) is provided with a plurality of break-off striations (23) aligned with cut outs 53 of the break-off portions 54 of side wall 22. In practice, these break-off points are two inches apart so that the slider may be quickly accommodated to existing shelf widths (depths) of, for example, ten inch, twelve inch, fourteen inch and sixteen inch commonly employed in the industry. It should be noted that sliders may be manufactured in varying width as compare slider 20*a* with slider 20 where the distance D of slider 20 is greater than distance Da of slider 20*a*.

While it is not an essential of the invention, I have found that white styrene is a preferable plastic from which to form the display units. It should be obvious to those skilled in the art that any suitable plastic material may be employed, as well as other materials such as wood and metal.

Figure 1:
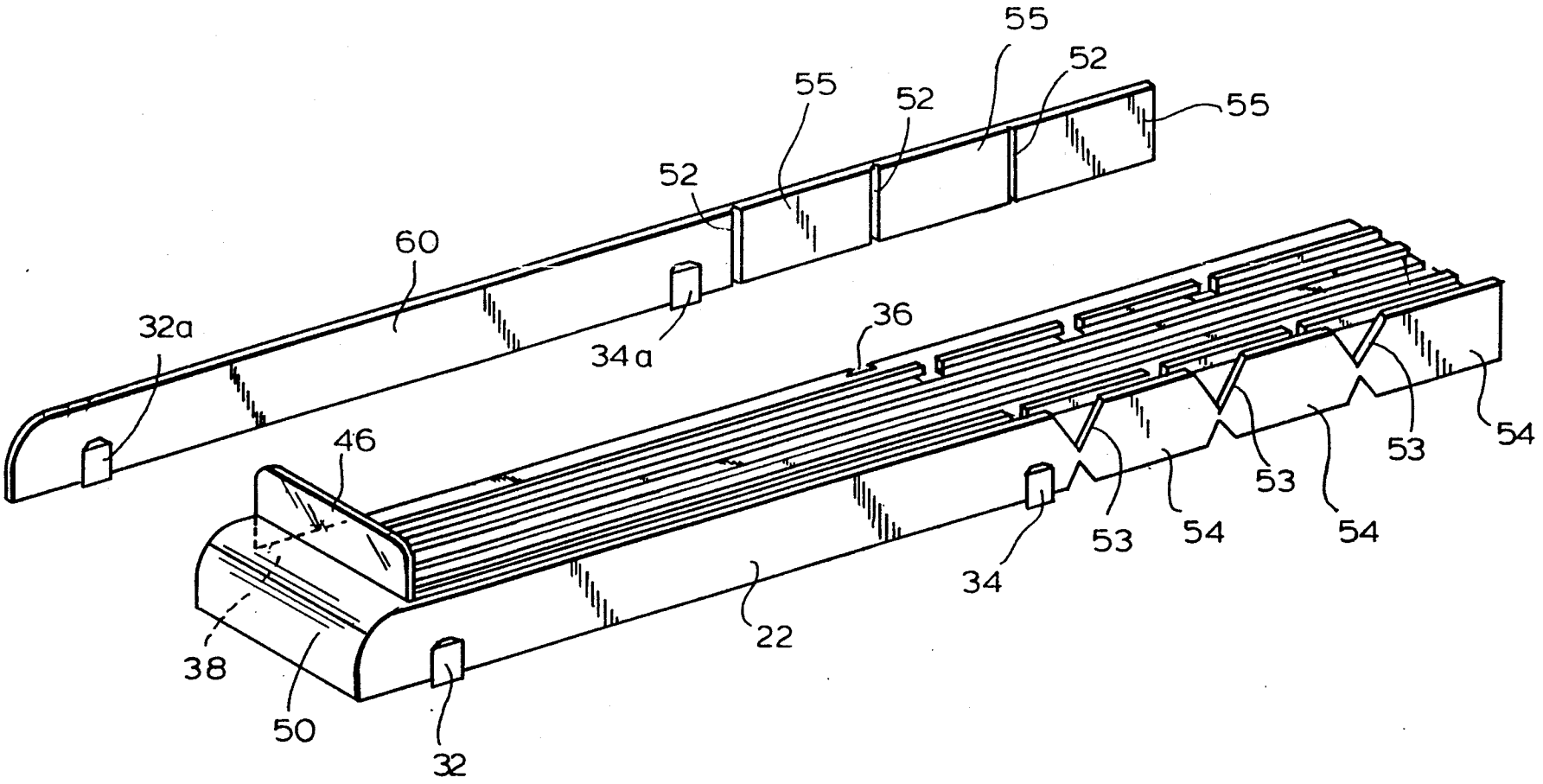
FIG. 1 is a perspective view, partly exploded, of a unit for forming the display.
Figure 2:
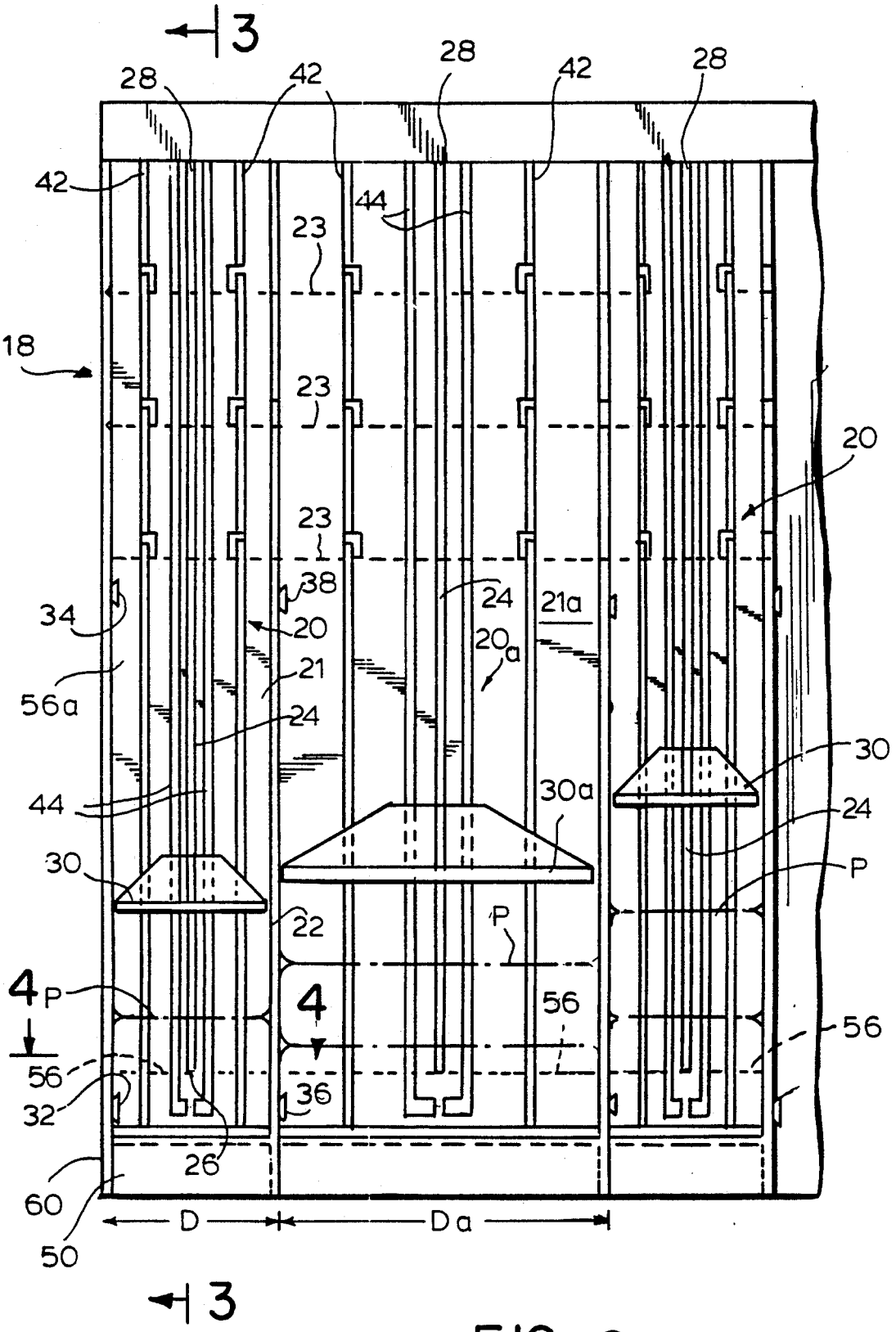
FIG. 2 is a plan view showing several units combined to form a display.
Figure 3:
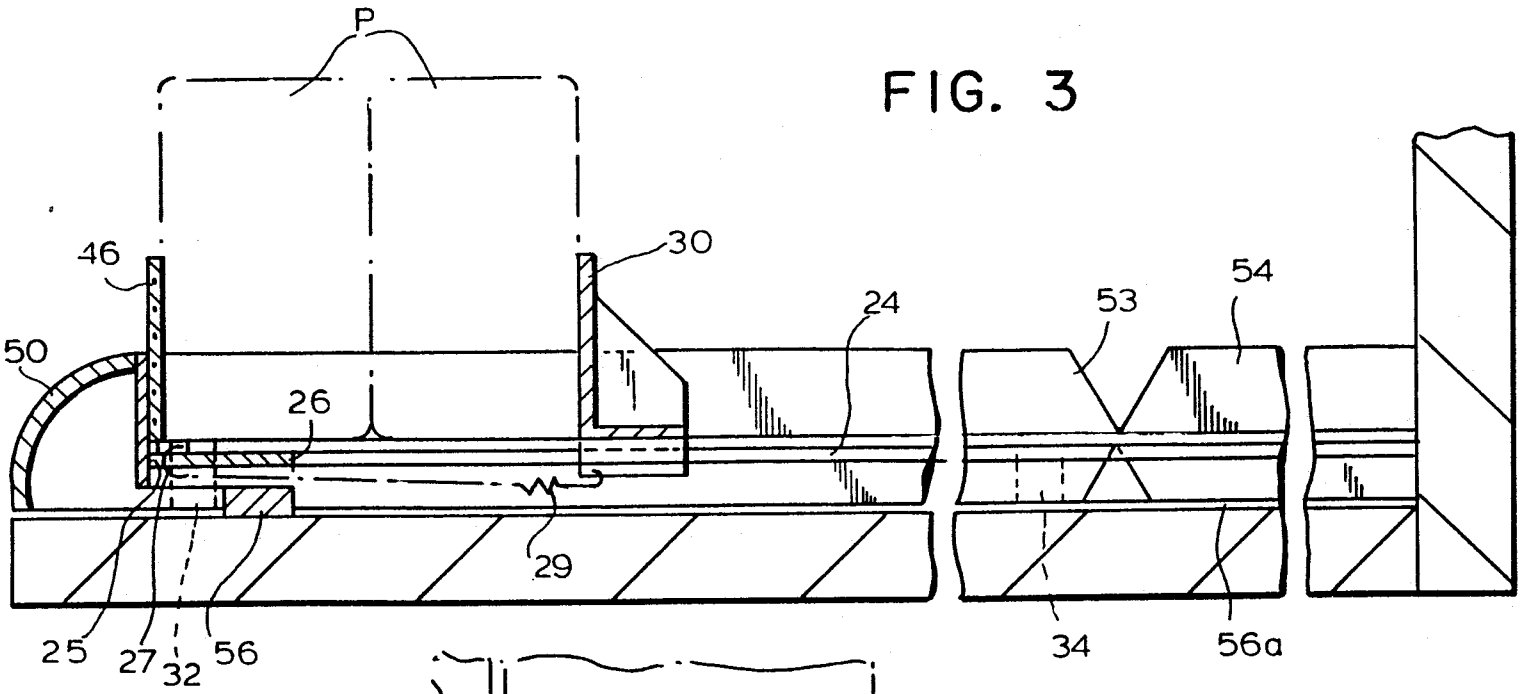
FIG. 3 is a longitudinal elevation taken on the line 3—3 of FIG. 2.

As illustrated in partially exploded FIG. 1 and in FIG. 2, the sliders 20, 20*a* when placed on a shelf, are joined by mating the male dovetails 32, 34 with the female dovetails 36, 38 of an adjacent slider. Additionally, each slider is provided with means to secure it to the shelf such as the magnet 56 embedded in the forward end of the base 21 (21*a*). In cases, I have found it sufficient to secure the forward end with pressure-sensitive tape 56*a* which may be bonded to the slider or be of the double sided adhesive type. With the sliders secured to each other by the mating dovetails 32, 36 and 34, 38 and to the shelf by means such as magnets 56 and tapes 56*a*, the structure has good stability. In fact, one or more of the magnets 56 and tapes 56*a* may in many adaptations, be partially or totally omitted.

An end wall or divider 60 with male dovetails 32*a* and 34*a* is also provided for use on the last of a group of sliders 20 (20*a*) (the last slider 20 (20*a*) is at the left as shown in FIG. 2). End wall 60 is also provided with break-off cuts 52 that will align with striation 23. The front of end wall 60 is curved on a radius r to correspond with the internal radius of curvature of the front piece 50. Break-away striations 52 permit the selective removal of break-away sections 55 (57*a*) of divider 60 (22).

As noted, dividers and end walls are rounded at their forward ends to a radius r to correspond to the radius of concavity r' of front piece 50. Of course, the front piece and forward ends of the dividers can be any shape but are shown rounded as an accommodation for product and price information which is inserted beneath front piece from the side, before being closed by a divider or end wall.

The purpose of having units of varying width is to accomodate goods of varying size (generally of the same or similar product). Thus, for particular clients such as Johnson & Johnson or Bristol-Meyers, the width of the sliders may be customized for their packaged product, but their length varied by the breakaways to suit the particular depth of the shelving in the retail outlet.

Referring now specifically to FIGS. 5 and 6, a slider 20 is shown in which the heightened side wall 22*b* has a slot at its upper forward end to receive a flexible stop 72. The lower portion 22*c* of divider 22*b* extends forwardly and is rounded to the radius r at its forward end. Stops 72 restrain product P (shown in dash-dot lines in FIG. 6) as it advances under the urging of pusher 74. However, a user or customer may pull product P through stops 72 which will flex (dotted lines FIG. 5) to permit egress of the product, particularly where the product may be stacked upon a similarly packaged product in the slider with little head room between the upper product and the next upper shelf. This construction is particularly useful in displaying and positioning cylindrical containers such as glass jars which may more conventionally be pulled through the stops instead of being lifted over them.

I find it convenient to form the slider 20 by injection molding of styrene. The injection mold is of the type that may be split to receive a spacing tool. Thus, the more usual width of the slider 20 is 1.6 inches. However, this can be increased by insertion of one or more tools or spacers to widen the mold. For example, if a 2 inch width is desired for the slider 20 and there is no objection to having pusher mechanism and its slot 24 slightly offset, a 0.4 inch tool may be inserted. For greater widths or where there is objection to offsetting the pusher, two such spacers may be inserted, one on each side of the pusher guide 24 so that the pusher is not offset. For example, a width of 2.4 inches can be achieved by adding two spacers of 0.4 inches on each side of the mold or two spacers of 0.2 inches for a width of 2.0 inches.

Thus, I have invented an improved slider which may be inexpensively produced and adapted to varied width shelving employed in retail-merchandising. The advantage of having only a single wall 22 serves not only as a space saver, but is aesthetically cleaner and more appealing than double wall structures heretofore employed. The dove-tail coupling provides rigidity and obviates the need of (1) framing and bulky mounting means for security and (2) mounting side walls on both sides of the base. The simplicity of the slider permits custom widths to be produced readily as by injection molding. Length is customized by the breakaway section.

What is claimed is:

1. A plurality of integrally formed display units suitable for placement on a flat surface, said display units each comprising an elongated integral base, a longitudinal edge on one side only of said base, a longitudinal slot formed in said base suitable to guide a pusher mechanism, a pusher mechanism engaging said slot and an integrally molded upstanding divider wall formed on one side only of said base opposite said longitudinal edge, first coupling means at the outwardly facing side of said divider wall, second coupling means on the longitudinal edge of said base opposite said wall, said second coupling means being positioned and formed to mate with said first coupling means of an adjacent unit, whereby said plurality of units may be matingly interlocked by said first and second coupling means in side-by-side parallel alignment for placement on a surface.

2. The units set forth in claim 1 further characterized in that said surface is a shelf and that one end of each unit has a break-away portion for adaptation to the width of said shelf.

3. The units of claim 1 further characterized in that securing means are provided on said units to secure said units on a surface.

4. The units as set forth in claim 3 and further characterized in that said securing means is a magnet.

5. The units as set forth in claim 3 and further characterized in that said securing means is pressure-sensitive tape.

6. The units of claim 3 further characterized in that said securing means is located on the bottom of said units.

7. The units of claim 6 and further characterized in that said securing means are at, at least, one end of said units.

8. The combination with at least one of said units such as set forth in claim 1 of a separate divider wall having coupling means matingly securable to said second coupling means on said unit to form an upstanding end wall on said unit.

9. A unit such as set forth in claim 1 having a rearward end and a forward end, and a member mounted on the forward end capable of displaying indicia.

10. The device set forth in claim 9 and further characterized by an optionally transparent stop adjacent the forward end of said unit but rearward of said member capable of displaying indicia.

11. A unit such as set forth in claim 1 having a pusher mechanism guided by said slot to move product forward and having a resiliently movable stop at one end of said unit, said stop resisting the movement of product urged by said pusher mechanism and resiliently movable to permit product to pass under further urging of a purchaser.

12. A plurality of integrally formed units such as set forth in claim 1 and further characterized in that the dimension of the widths of said elongated bases vary one from the other.

13. The plurality of integral units set forth in claim 12 formed from a polymer cast by a split injection mold having at least one spacing tool to produce units of varying width.

14. The plurality of integral units set forth in claim 12 formed from a polymer cast by a split injection mold having at least two spacing tools to produce units of varying width at least one of which units have said longitudinal slot off center.

15. A plurality of units such as set forth in claim 1 and further characterized by a flexible stop adjacent the forward end of said units and said stop is secured at the forward end of said side wall.

16. A display for placement on a shelf comprising a plurality of adjacent units, said units being each formed of an integrally formed rectangular base having an integral side wall on one side, said rectangular bases each having a given length, first means on said one side of each of said units, second means on the opposite side of each of said units, said first means and said second means being constructed and arranged to matingly couple the first means of one unit to the second means of an adjacent unit, said units being of selected widths corresponding to product to be displayed and having at least one breakaway section to selectively provide a length corresponding to the width of the shelf, a single last side wall having said first means formed in its side to couple with said second means on the last unit at the said opposite side, and securing means on at least one of said units to secure said unit and said display to a shelf.

17. A plurality of units such as set forth in claim 16 and further characterized by a biased movable stop adjacent the forward end of said units biased to resist the pusher mechanism and yield to an increased force by a purchaser.

18. The display of claim 17 further characterized in that said first means is a male dovetail and said second means is a female dovetail.

19. The display of claim 17 further characterized by said rectangular base having a slot formed therein and a pusher mounted to slide along said slot.

20. The display of claim 19 further characterized by rails formed on said base and said pusher is spring biased to slide along said rails and said slot.

21. A display for a shelf comprising at least one unit formed of a base extending forwardly and rearwardly and having side walls on the sides thereof and pusher means extending between said walls for urging products forwardly said side walls having flexible stop means at their forward ends extending laterally toward one another for stopping the forward movement of the product under the urging of said pusher means and for flexing forwardly to permit the product to pass under further urging of a purchaser.

* * * * *

UNITED STATES PATENT AND TRADEMARK OFFICE

CERTIFICATE OF CORRECTION

PATENT NO. : 5,265,738
DATED : November 30, 1993
INVENTOR(S) : Gerald Yablans et al.

It is certified that error appears in the above-identified patent and that said Letters Patent is hereby corrected as shown below:

Column 5, line 14, "optionally" should be --optically--.

Signed and Sealed this

Nineteenth Day of April, 1994

Bruce Lehman

*Attest:*

BRUCE LEHMAN

*Attesting Officer*

*Commissioner of Patents and Trademarks*